United States Patent [19]

Matoba

[11] Patent Number: 4,799,298

[45] Date of Patent: Jan. 24, 1989

[54] STRAP RETAINER

[75] Inventor: Hiroshi Matoba, Toyama, Japan

[73] Assignee: Yoshida Kogyo K. K., Tokyo, Japan

[21] Appl. No.: 80,066

[22] Filed: Jul. 31, 1987

[30] Foreign Application Priority Data

Aug. 2, 1986 [JP] Japan ..... 61-118977[U]

[51] Int. Cl.[4] ..... A43C 5/00; A41F 1/00

[52] U.S. Cl. ..... 24/140; 24/144

[58] Field of Search ..... 24/90 TA, 163 R, 163 K, 24/184, 198, 199, 200, 182, 265 R, 265 LD, 140, 144, 145, 396, 696, 681, 697, 695, 689, 694; 248/499, 505; 410/101, 102, 106, 107, 108, 109, 110, 111, 112, 116, 156; 2/335, 421; 450/86, 88

[56] References Cited

U.S. PATENT DOCUMENTS

| | | | |
|---|---|---|---|
| 1,680,623 | 8/1928 | Kinney | 24/90 TA |
| 3,195,201 | 7/1965 | Ash | 24/689 |
| 4,488,333 | 12/1984 | Tracy | 24/140 |
| 4,520,533 | 6/1985 | Kasai | 24/198 |

FOREIGN PATENT DOCUMENTS

| | | | |
|---|---|---|---|
| 663190 | 5/1965 | Belgium | 24/696 |
| 69025 | 3/1945 | Norway | 24/90 TA |

*Primary Examiner*—Kenneth J. Dorner
*Assistant Examiner*—James R. Brittan
*Attorney, Agent, or Firm*—Hill, Van Santen, Steadman & Simpson

[57] ABSTRACT

A strap retainer includes a flexible plate adapted to be attached by sewing to a substrate, and a retaining mound integral with the plate and raised above the upper surface of the plate so as to define therebetween a pair of laterally aligned apertures for the passage therethrough of the strap. A sewing groove extends in the upper surface of the plate along a peripheral edge of the plate for receiving a sewing thread. A support ridge projects from the bottom surface of the plate and extends along the peripheral edge of the plate, the ridge being disposed inwardly of and immediately adjacent to the sewing groove. The strap retainer thus constructed is free from curling up around the periphery thereof and is capable of protecting the sewing thread against abrasive wear.

2 Claims, 4 Drawing Sheets

STRAP RETAINER

BACKGROUND OF THE INVENTION

1. Field of the Invention

This invention relates to a strap retainer for retaining a strap, belt or the like in place on a substrate such as a bag, knapsack, garment, tent or the like.

2. Prior Art

There have been proposed numerous lash devices including strap retainers in which contrivances have been incorporated to reduce wearing of the sewn thread attaching the device to the substate and to eliminate curling up of the edges of the device. A typical such device is disclosed in U.S. Pat. No. 4,488,333 which provides a thin patch-like plate having a recessed attaching area defined between a raised peripheral border region and a plurality of projections and a uniform recessed underside defined by a continuous narrow peripheral marginal edge. While the thread sewn in the attaching area is protected by the projections against abrading wear with an extraneous object, the portions of the thread that are exposed in the recessed underside are still liable to abrasive wear. Furthermore, with a thin flexible substrate, the thread sewn thereto through the underside of the plate urges the substrate to move inwardly of the marginal peripheral edge of the plate, resulting in a gap between the substrate and the plate which would in turn lead to curling up of the edge of the plate.

SUMMARY OF THE INVENTION

With the foregoing problems of the prior art in view, it is therefore the principal object of the present invention to provide an improved strap retainer which is free from curling up or otherwise being deformed and which is capable of protecting the sewing thread against abrasive wear.

According to the present invention, the foregoing and other objects are attained by a strap retainer comprising a flexible plate having a groove defined in an upper surface of the plate and extending along a peripheral edge of said plate for receiving a sewing thread for the attachment to a substrate, at least one retaining mound integral with the plate and raised above the upper surface of the plate so as to define therebetween a pair of laterally aligned apertures for the passage therethrough of a strap, and a support ridge projecting from a bottom surface of the plate and extending along the peripheral edge of the plate, the support ridge being disposed inwardly of and immediately adjacent to the groove.

Many other advantages and features of the present invention will become manifest to those versed in the art upon making reference to the detailed description and the accompanying sheets of drawings in which preferred structural embodiments incorporating the principles of the present invention are shown by way of illustrative example and in which like reference numerals refer to like or corresponding parts throughout the several views.

DETAILED DESCRIPTION

Figure 1:
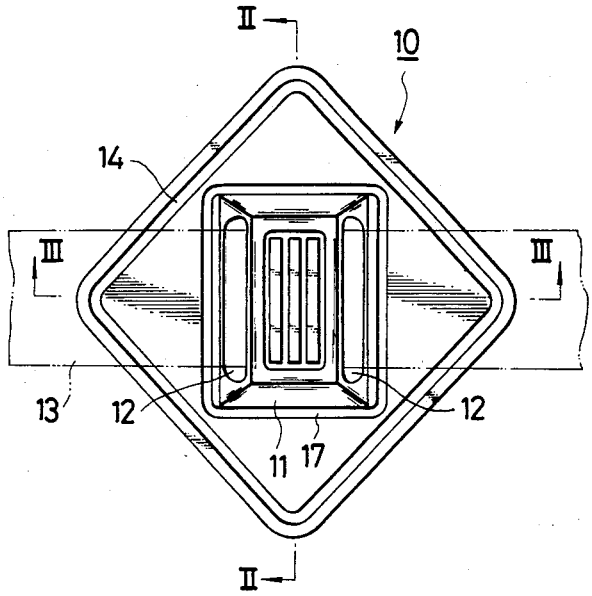
FIG. 1 is a plan view of a strap retainer constructed in accordance with the principles of the invention.

Referring now to the drawings and FIG. 1 in particular, there is shown a strap retainer 10 embodying the invention which is made of a flexible material such as plastic or leather material and which is in the form of a thin square plate. The strap retainer or plate 10 has integral therewith a rectangular strap retaining mound 11 centrally disposed and oriented to define a triangular area with each of four corners of the square plate 10. The retaining mound 11 is slightly raised above the upper surface of the plate 10 to provide a pair of elongated parallel apertures 12 on opposite longitudinal sides of the mound 11 for the passage therethrough of a strap or belt indicated in broken lines at 13 in FIG. 1.

Figure 5:
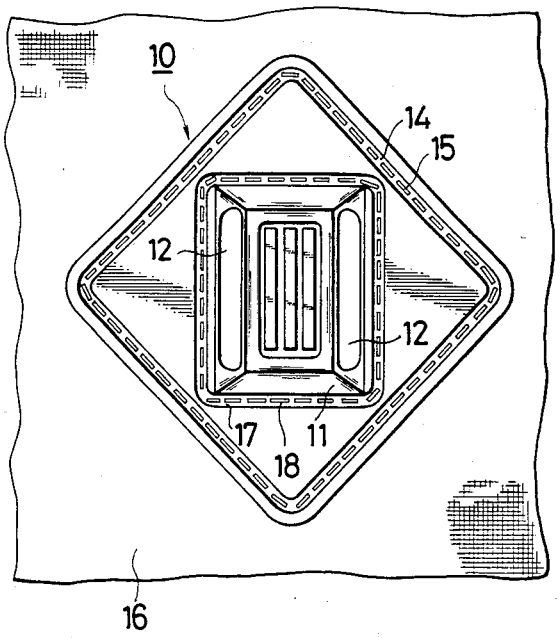
FIG. 5 is a plan view of the strap retainer shown attached to a substrate.

A sewing groove 14 is formed in the upper surface of the plate 10 and extending continuously and closely along the peripheral edges of the plate 10 for receiving a thread 15 which secures the plate 10 to a substrate such as a garment fabric 16 as shown FIG. 5, the groove 14 serving to protect the thread 15 from exposure to abrasive wear. The thread 15 being located closely adjacent to the marginal edges of the plate 10 holds the latter flat against the substrate 16 and against curling up.

Designated at 17 is a sewing groove which extends continuously around the peripheral edges of the rectangular mound 11 and which is adapted to receive a sewn thread 18 securing inner portions of the retainer 10 to the substrate 16.

Figure 4:
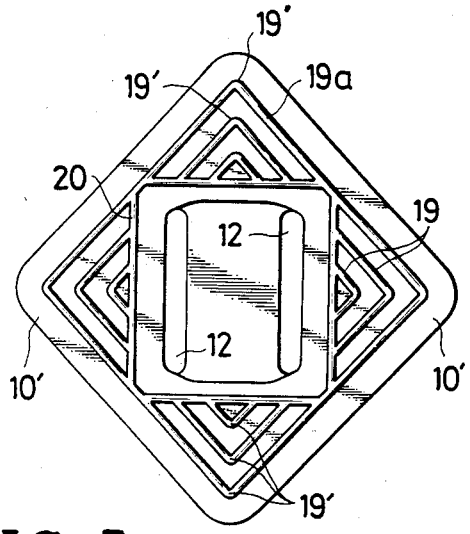
FIG. 4 is a bottom view of the strap retainer of FIG. 1.

FIG. 4 shows the reverse side of the strap retainer 10. The retainer 10 includes a plurality of support ridges 19 extending in parallel with the marginal edge lines of the retainer 10 and slightly protruding above the lower surface of the retainer 10. There is also provided a similar ridge 20 on the bottom surface of the plate 10 in surrounding relation to the peripheral edges of the retaining mound 11. The ridges 19 particularly with their corners 19' and together with the ridge 20 serve to hold the retainer 10 from slipping or otherwise moving relative to the substrate 16 during sewing attachment of the two parts that can thus be joined together in the proper intended position.

Figure 2:
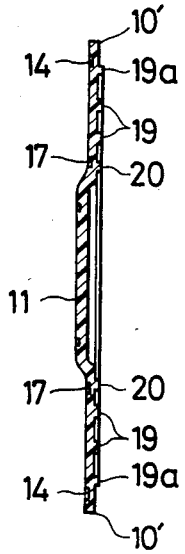
FIG. 2 is a cross-sectional view taken along the line II—II of FIG. 1.
Figure 3:
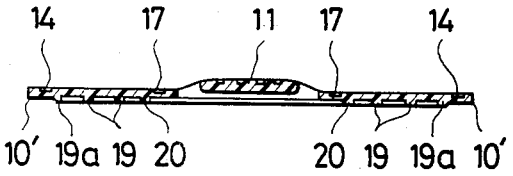
FIG. 3 is a cross-sectional view taken along the line III—III of FIG. 1.
Figure 6:
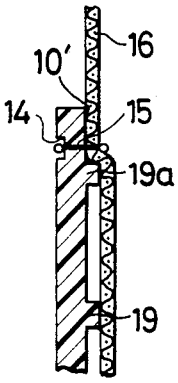
FIG. 6 is an enlarged cross-sectional view of a peripheral portion of the strap retainer shown in FIG. 5.
Figure 7:
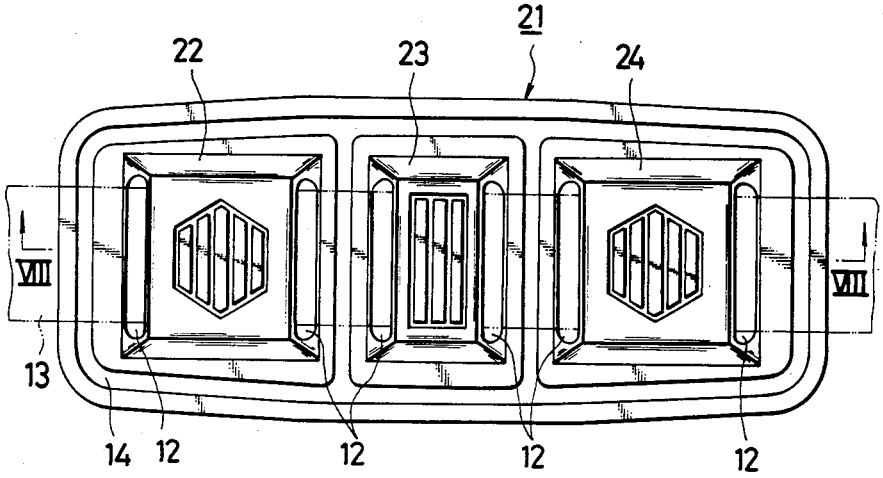
FIG. 7 is a plan view of a modified form of strap retainer embodying the invention.
Figure 8:
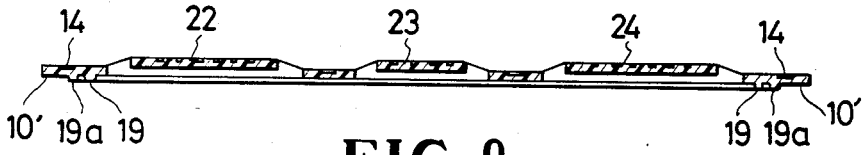
FIG. 8 is a cross-sectional view taken along the line XIII—XIII of FIG. 7.
Figure 9:
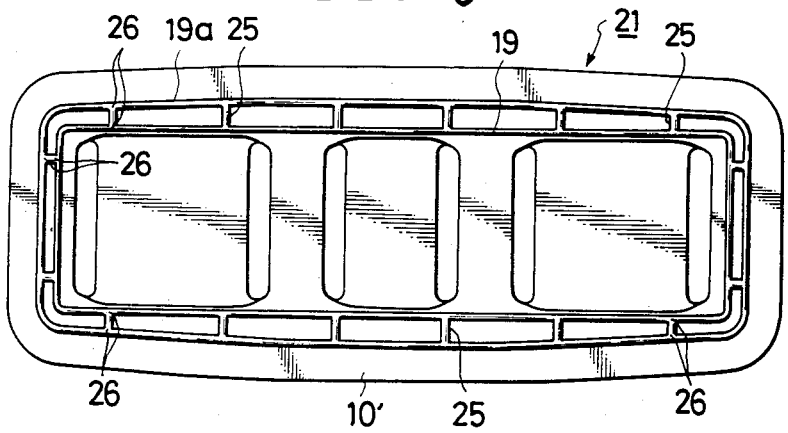
FIG. 9 is a bottom view of the strap retainer of FIG. 7.
Figure 10:
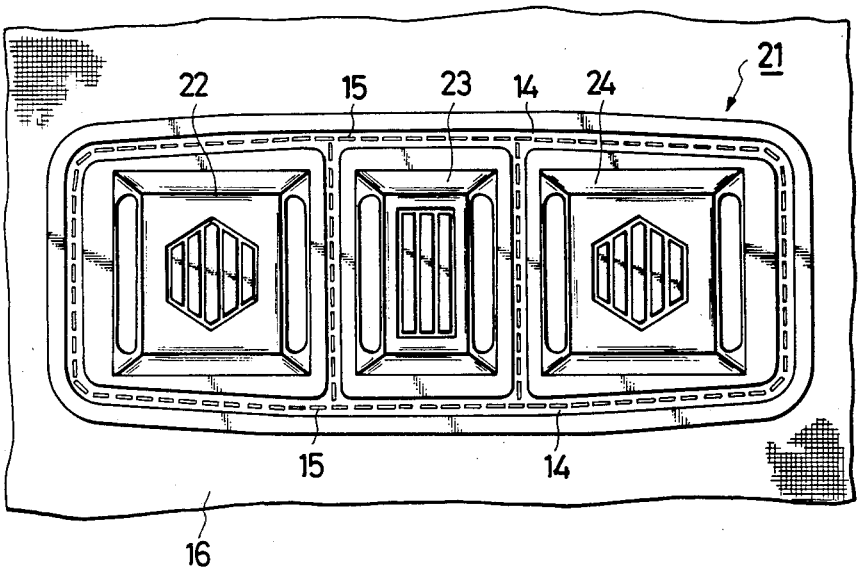
FIG. 10 is a plan view of the strap retainer of FIG. 7 shown attached to a substrate.
Figure 11:
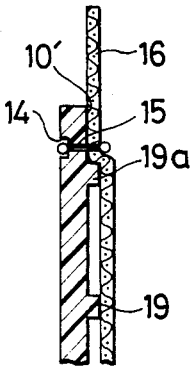
FIG. 11 is an enlarged cross-sectional view of a peripheral portion of the strap retainer of FIG. 7.

The outermost ridge **19*a* in particular is located immediately adjacent to but inwardly of the outermost sewing groove 14 as shown in FIGS. 2, 3 and 6, so that the thread 15 when sewn through the groove 14 anchors the substrate 16 against the ridge 19*a* and lies below the bottom face of the substrate to evade abrasive contact, as better shown in FIG. 6**.

The bottom peripheral edge portions 10' of the retainer 10 are rendered flat and smooth so that these edge portions can be held in intimate engagement with the substrate 16 without developing an objectionable gap therebetween.

Referring to FIG. 7–11 inclusive, there is shown a modified form of strap retainer 21 which is rectangular in shape and generally similar to the retainer 10 except that it includes three retaining mounds 22, 23 and 24, the outer mounds 22 and 24 being of a similar size and the center mound 23 being somewhat narrower. The retainer 21 is substantially similar in construction and function to the retainer 10 already described. The support ridges 19 are interconnected by cross bars 25 at suitable intervals to provide multiple joints 26 which serve to hold the retainer 21 in place during sewing of the same to the substrate 16. The outermost ridge **19*a* is likewise located immediately adjacent to and inwardly of the sewing groove 14 as better shown in FIG. 11** for reasons already advanced.

Although various minor modifications may be suggested by those versed in the art, it should be understood that I wish to embody within the scope of the patent warranted hereon, all such embodiments as reasonably and properly come within the scope of my contribution to the art.

For example, the shape of the retainer 10 or 21 may be circular, in which instance the ridges 19, 20 may be provided preferably in concentric relation to such a circular retainer.

What is claimed is:

1. A strap retainer for retaining a strap to a substrate, comprising:

(a) a flexible plate adapted to be attached to the substrate and having a groove defined in an upper surface of said plate and extending along a peripheral edge of said plate for receiving therein a sewing thread;

(b) at least one retaining mound integral with said plate and raised above said upper surface of said plate so as to define therebetween a pair of laterally aligned apertures for the passage therethrough of the strap;

(c) a support ridge projecting from a bottom surface of said plate and extending along said peripheral edge of said plate, said ridge being disposed between said retaining mound and said groove immediately adjacent to said groove; and (d) said plate further including at least one first ridge disposed between said support ridge and said retaining mound and extending parallel with said support ridge, and a second ridge disposed on said bottom surface thereof and extending in surrounding relation to said mound, said first and second ridges intersecting each other.

2. A strap retainer for retaining a strap to a substrate, comprising:

(a) a flexible plate adapted to be attached to the substrate and having a groove defined in an upper surface of said plate and extending along a peripheral edge of said plate for receiving therein a sewing thread;

(b) at least one retaining mound integral with said plate and raised above said upper surface of said plate so as to define therebetween a pair of laterally aligned apertures for the passage therethrough of the strap;

(c) a support ridge projecting from a bottom surface of said plate and extending along said peripheral edge of said plate, said ridge being disposed between said retaining mound and said groove immediately adjacent to said groove; and (d) said plate further including at least one first ridge disposed between said support ridge and said retaining mound and extending parallel with said support ridge, and a plurality of cross bars extending between said support ridge and said first ridge.

* * * * *